US005322200A

United States Patent [19]

Blanchard

[11] Patent Number: 5,322,200

[45] Date of Patent: Jun. 21, 1994

[54] STORAGE HOLSTER

[76] Inventor: Keith R. Blanchard, 31 Hobson Ave., Taunton, Mass. 02780

[21] Appl. No.: 44,768

[22] Filed: Apr. 12, 1993

[51] Int. Cl.[5] ..... F41C 33/04

[52] U.S. Cl. ..... 224/192; 224/911; 224/912; 224/243; 224/193

[58] Field of Search ..... 224/912, 911, 192, 193, 224/198, 243, 244

[56] References Cited

U.S. PATENT DOCUMENTS

| | | | |
|---|---|---|---|
| 2,297,008 | 9/1942 | McMillan | 224/243 |
| 2,455,635 | 12/1948 | Witte | 224/912 |
| 2,546,774 | 3/1951 | Ohlemeyer | 224/243 |
| 2,893,615 | 7/1959 | Couper | 224/912 X |
| 3,828,990 | 8/1974 | Baldocchi | 274/912 X |
| 4,076,156 | 2/1978 | Katz | 224/243 |
| 4,485,948 | 12/1984 | Cook | 224/243 |
| 4,858,799 | 8/1989 | Young | 224/243 |
| 4,886,197 | 12/1989 | Bowles et al. | 224/243 |

*Primary Examiner*—Ernest G. Cusick
*Attorney, Agent, or Firm*—John P. McGonagle

[57] ABSTRACT

A metallic storage holster and cable for locking a handgun in place and preventing access to the handgun by unauthorized persons. The cable is welded onto a one side of the storage holster. The non-welded cable end is formed into a loop. The loop is then secured over a "U" latch welded onto the other side of the storage holster. The latch is large enough to allow a lock to be inserted through the eye of the latch once the looped cable end has been fitted. Once the lock is in place, access to the handgun is restricted to the individual able to open the lock. A metallic plate is welded onto one side of the storage holster and holes are cut through both sides of the storage holster to allow lag bolts to be inserted and countersunk though the side with the plate attached thereto. The lag bolts, once in place, are used to mount the storage holster. Once a handgun is locked in place access to the lag bolts from the other side of the storage holster is blocked.

2 Claims, 3 Drawing Sheets

STORAGE HOLSTER

BACKGROUND OF THE INVENTION

This invention relates to storage means for handguns, and in particular to a holster for the storage of a handgun and for the prevention of the handgun being removed by an unauthorized person.

The present invention discloses a means for the easy and economical storage of personal handguns and the like. In addition, the invention is used for the prevention of the armament from being used by unauthorized persons such as children and burglars.

With the increase in burglaries and other crimes effecting the home, many home owners have chosen to arm themselves. In order to be effective a firearm must be readily available. However, given the dangerous nature of having a loaded firearm about for use by unauthorized persons, additional safety measures need to be taken with the firearm's storage.

The prior art discloses complicated apparatuses for use in securing and controlling access to firearms. U.S. Pat. No. 5,108,019, issued to Woodward et al., discloses a holster including a flexible strap fitting behind the trigger of a handgun to secure the handgun in a holster. The Woodward et al. apparatus also includes an alarm system that is activated when said strap is unfastened. This apparatus is fundamentally distinguished from the present invention in that the primary function of the Woodward et al. apparatus is to warn the household of the handguns removal and potentially scare children or other unauthorized users away from tampering with the handgun. The instant apparatus is designed to prevent a firearms removal rather than warn of its removal.

U.S. Pat. No. 4,858,799, issued to Young, discloses a holster with a locking mechanism specially designed to fit snugly about a specific part of a handgun. The apparatus includes a radially moveable arm that is locked into place by means of a locking screw. Once in place the arm blocks the removal of the handgun. This apparatus is distinguished from the instant invention in several respects. The Young apparatus is shown as being warn on a belt about the waste. The instant apparatus is made of steel and is intended to be mounted on a wall. The Young invention requires the arm to fit about a specific part of the handgun thus making the apparatus handgun specific. The instant invention may be used with any firearm that can be made to securely fit within the instant holster. The Young invention's locking means includes a locking screw that can be easily accessed and undone by anyone. The instant invention specifically calls for a locking means that is not accessible nor undone by anyone except the intended owner of the firearm. The last of these distinctions is a fundamental difference between the Young and instant apparatus.

Although other known prior art teaches of storing a firearm in a mounted lock box, none disclose use of a holster. A holster, used as in the instant invention, allows for the storage of a variety of firearms, as oppose to being firearm specific like the prior art. The present invention also permits a gun collector or a gun store to display a firearm, especially a handgun, in a safe and secure environment.

SUMMARY OF THE INVENTION

The present invention provides for storage of a handgun in a lined steel storage holster. The lining is intended to prevent scratching of the handgun. The storage holster includes mounted brackets on the back surface to facilitate mounting on any wall or bed frame. The mounting is so positioned as to prevent access to the mounts when a handgun is being stored within the storage holster. This feature dissuades unauthorized tampering with or removal of the storage holster.

The storage holster also includes a locking mechanism that is easily adjustable to any style handgun. The locking mechanism provides a plastic coated steel cord adaptable to fit about any handgun and lock into place on an opposite side of the storage holster. The cord can be locked with a padlock or combination lock or the like as the owner sees fit. As the locking mechanism can only be accessed by a key or secret combination it allows the key bearer easy access to the firearm while preventing unauthorized access.

It is thus the primary object of the invention to provide secured and controlled access to a handgun.

It is further the object of the present invention to provide such control in an uncomplicated and inexpensive manner.

These together with other objects of the invention, along with various features of novelty which characterize the invention, are pointed out with particularity in the claims annexed hereto and forming a part of this disclosure. For a better understanding of the invention, its operating advantages and the specific objects attained by its uses, reference should be had to the accompanying drawings and descriptive matter in which there is illustrated a preferred embodiment of the invention.

DETAILED DESCRIPTION OF THE INVENTION

Figure 1:
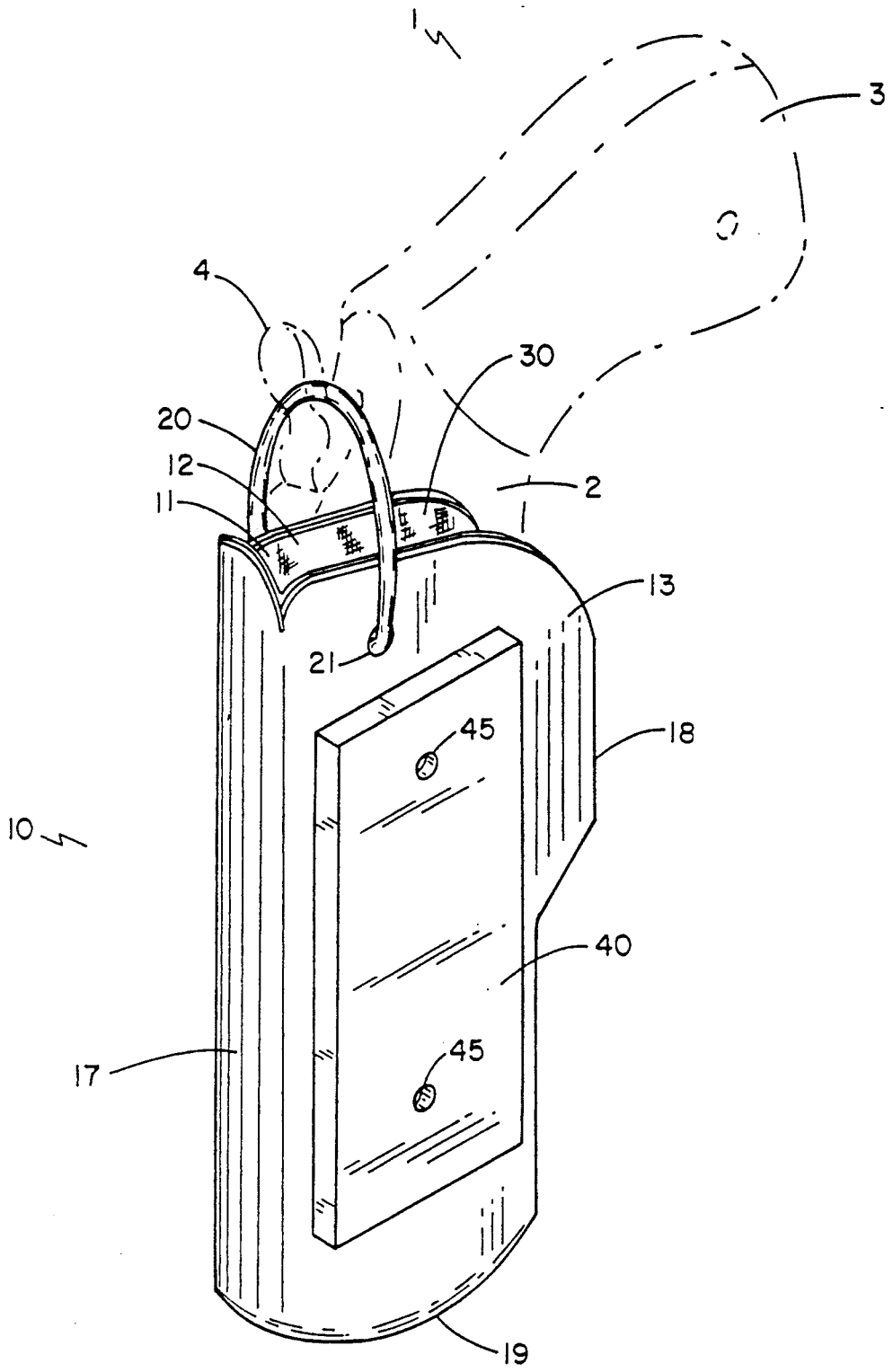
FIG. 1 is a front, right perspective view of the preferred embodiment of the storage holster.
Figure 2:
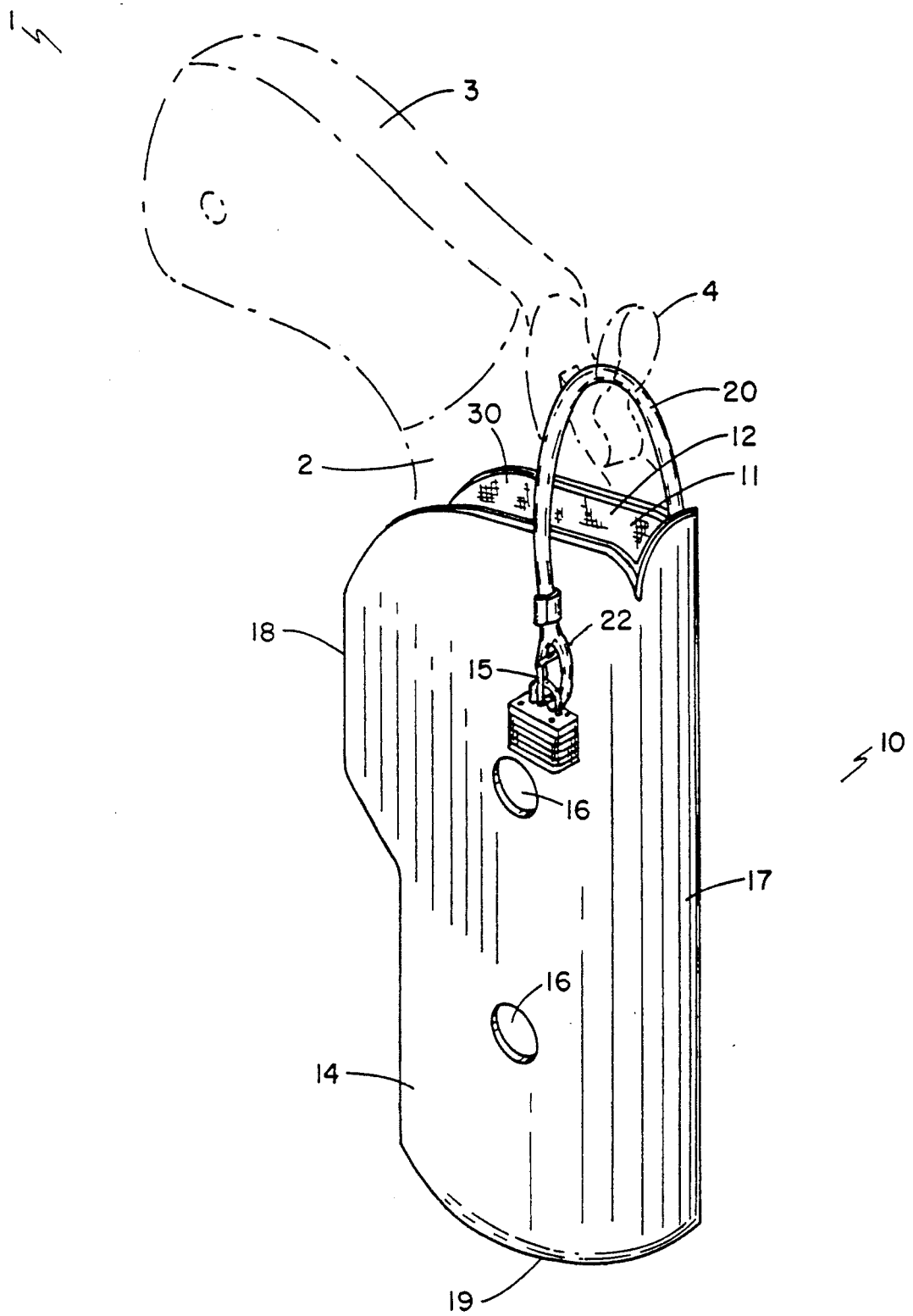
FIG. 2 is a front, left perspective view of the holster of FIG. 1.
Figure 3:
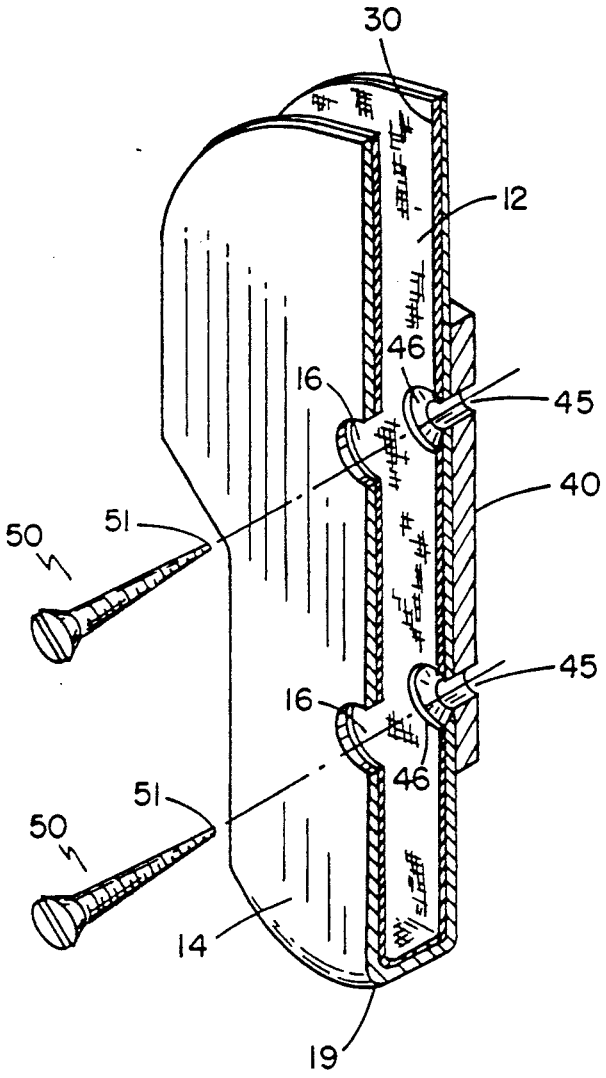
FIG. 3 is a plan view of the holster of FIG. 2 with the front portion cut away.

Referring to the drawings in detail wherein like elements are indicated by like numerals, the instant invention is comprised of a hollow storage holster 10, for holding a conventional handgun 1. The holster 10 is formed from one-eighth inch steel, has a front 17, back 18, left side 14, right side 13, bottom 19 and an upwardly-open mouth 11 for receiving the barrel portion of a handgun 1. The handgun 1 has a conventional shape with a barrel (not shown), receiver 2 and hand grip 3. The receiver 2 has a conventional trigger means (not shown) and an exposed hammer 4 protruding from the receiver 2. The handgun 1 extends partway into the holster 10 so that the handgrip 3 and hammer 4 are exposed, i.e., outside the holster 10. The overall size of the storage holster 10 varies according to the size of the handgun 1 to be stored therein. The storage holster's size must be sufficient to snugly secure the handgun and prevent it from twisting. It is also desirable that the storage holster 10 prevent access to the trigger means. The interior 12 of the storage holster 10 is lined with felt 30 or a similar soft fabric to prevent scratching or the handgun 1 when stored within the storage holster 10.

The invention is further comprised of a steel cable 20 coated with plastic, rubber or the like. The cable has two ends 21, 22, one of which 21 is attached to the holster's right side 13. The other cable end 22 is formed into a loop. A 'U' shaped latch 15 is welded onto the left side 14 the storage holster 10. The loop 22 is adapted to fit snugly around the latch 15, leaving sufficient room on the latch 15 to house a padlock, or similar locking device, (not shown) thereon.

As may be most clearly seen from FIG. 1, the holster right side 13 has a generally rectangular plate 40 attached thereto. In this embodiment of the invention the plate 40 is one-half inch thick steel. Two attachment holes 45 are formed in the plate 40 and extend through the right side 13 of the holster 10. In this embodiment of the invention the holes 45 are ⅜" (three eights inch) in diameter. The holes 45 are countersunk, ¼ inch deep and, 13/16 inch in diameter, from the interior 12 of the right side 13. Two holes 16 are cut into a central portion of the left holster side 14. In this embodiment of the invention the holes 16 are 13/16 (thirteen sixteenths) of an inch in diameter. The holes 16 and 45 are collinear. The lines aligning the two holes 16 and the two holes 45 are perpendicular from the bottom 19 of the storage holster 10. The size of the front holes 16 can be varied according to individual mounting needs.

Two lag bolts 50 are provided. The lag bolts 50 are inserted through the left side holes 16, through the countersunk holes 45 from the interior 12 of the right side 13 through the plate 40. The ends 51 of the lag bolts 50 sticking out through the plate 40 are for mounting said storage holster 10. The lag bolt heads 52 fit into the countersunk hole bores 46 and will not interfere with the handgun 1 when inserted into the holster 10. Once the holster 10 is mounted, a handgun 1 stored within the storage holster 10, will block access to the lag bolts 50. This will prevent unauthorized tampering with the mounting of the storage holster 10.

It is understood that the above-described embodiment is merely illustrative of the application. Other embodiments may be readily devised by those skilled in the art which will embody the principles of the invention and fall within the spirit and scope thereof. Therefore it is intended in the appended claims to cover all such equivalent variations that come within the scope of the invention.

I claim:

1. A holster, attached to an external surface, for storing a handgun and preventing its unauthorized use, said handgun having a conventional shape with a barrel, a receiver with a conventional trigger means and a hammer protruding from the receiver, and a hand grip, comprising:

a metallic, hollow holster adapted to receive said barrel portion of said handgun, with the handgrip and hammer exposed, said holster having a front, back, left side, right side, bottom, interior and an upwardly-open mouth for receiving the barrel portion of said handgun;

soft fabric lining said interior;

a 'U' shaped latch attached onto the left side the storage holster;

a steel cable coated with a resilient material, said cable having two ends, one end attached to the holster's right side and the other cable end formed into a loop, said loop being adapted to fit snugly around the latch; and locking means for attachment to said latch.

2. A holster as recited in claim 1, further comprising:

a generally rectangular metallic plate attached to the right side of said holster;

two attachment holes formed in the plate and extending through the right side of the holster, said holes being countersunk from the holster interior into the right side;

two side holes cut into a central portion of the left holster side, said side holes and said attachment holes being collinear; and two lag bolts inserted through the side holes, through the countersunk attachment holes and through the plate, whereby the holster is mounted to be an external surface by attachment of said lag bolts through said holster to said external surface.

* * * * *